US012173630B2

(12) United States Patent
Purkar et al.

(10) Patent No.: US 12,173,630 B2
(45) Date of Patent: Dec. 24, 2024

(54) DEACTIVATING VALVETRAIN ASSEMBLY

(71) Applicant: Eaton Intelligent Power Limited, Dublin (IE)

(72) Inventors: Ketaki Purkar, Pune (IN); Soorajkrishna Srikumar, Pune (IN); Vikram Deokar, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/263,234

(22) PCT Filed: Apr. 21, 2021

(86) PCT No.: PCT/EP2021/025150

§ 371 (c)(1),
(2) Date: Jul. 27, 2023

(87) PCT Pub. No.: WO2022/171260

PCT Pub. Date: Aug. 18, 2022

(65) Prior Publication Data

US 2024/0084723 A1 Mar. 14, 2024

(30) Foreign Application Priority Data

Feb. 12, 2021 (IN) ..... 202111005980

(51) Int. Cl.
*F01L 9/21* (2021.01)
*F01L 13/00* (2006.01)

(52) U.S. Cl.
CPC ..... *F01L 9/21* (2021.01); *F01L 13/0005* (2013.01); *F01L 2009/213* (2021.01); *F01L 2009/2146* (2021.01)

(58) Field of Classification Search
CPC ..... F01L 1/267; F01L 9/21; F01L 2009/2146
See application file for complete search history.

(56) References Cited

U.S. PATENT DOCUMENTS

| | | | |
|---|---|---|---|
| 6,318,318 | B1 | 11/2001 | Jahr |
| 10,612,428 | B1 | 4/2020 | Patterson |
| 2017/0241300 | A1 | 8/2017 | Liskar |
| 2018/0142583 | A1 | 5/2018 | Liskar |
| 2020/0308997 | A1 | 10/2020 | Altherr |

FOREIGN PATENT DOCUMENTS

| | | | |
|---|---|---|---|
| DE | 102014205813 | A1 | 10/2015 |
| DE | 102018107390 | A1 | 10/2019 |
| EP | 3173594 | B1 | 12/2019 |
| WO | WO 2018075341 | A1 | 4/2018 |

OTHER PUBLICATIONS

International Search Report and Written Opinion for International Application No. PCT/ EP2021/025150, 11 pages, Dec. 1, 2021.

*Primary Examiner* — Ngoc T Nguyen
(74) *Attorney, Agent, or Firm* — Baker Botts L.L.P.

(57) ABSTRACT

A valvetrain assembly comprising a first body and a second body, wherein the second body comprises a first wall and a second wall. The valvetrain assembly further comprises a first latch pin, wherein the first latch pin is configured to latch the second body to the first body and unlatch the second body from the first body. A portion of the first latch pin is located between the first wall and the second wall. The valvetrain assembly also comprises a movable shaft, wherein the movable shaft is configured to move the first latch pin. The valvetrain assembly comprises an electromagnet, wherein the electromagnet is configured to move the movable shaft.

15 Claims, 6 Drawing Sheets

DEACTIVATING VALVETRAIN ASSEMBLY

PRIORITY

This application claims the benefit under 35 U.S.C. § 371 of International Patent Application No. PCT/EP2021/025150, filed 21 Apr. 2021, which claims the benefit under 35 U.S.C. § 119(e) of Indian Provisional Patent Application No. 202111005980, filed 12 Feb. 2021, which are incorporated herein by reference.

FIELD

This application provides a valvetrain assembly configured to latch and unlatch portions of the valvetrain assembly using an electromagnet, a shaft, and latch pins.

BACKGROUND

Valvetrain assemblies can be configured to deactivate an engine cylinder by modifying a portion of the valvetrain in a way that allows valves to remain closed while other parts of the assembly continue to move. Some valvetrain assemblies modify the cam or rocker arm to achieve cylinder deactivation. Cylinder deactivation can improve fuel consumption and improve engine efficiency. Valvetrain assemblies with valve bridges and multiple valves present challenges in achieving cylinder deactivation.

SUMMARY

The methods and devices disclosed herein overcome the above disadvantages and improve the art by way of a valvetrain assembly comprising a first body and a second body, wherein the second body comprises a first wall and a second wall. The valvetrain assembly further comprises a first latch pin, wherein the first latch pin is configured to latch the second body to the first body and unlatch the second body from the first body. A portion of the first latch pin is located between the first wall and the second wall. The valvetrain assembly also comprises a movable shaft, wherein the movable shaft is configured to move the first latch pin. The valvetrain assembly comprises an electromagnet, wherein the electromagnet is configured to move the movable shaft.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Reference will now be made in detail to the examples which are illustrated in the accompanying drawings. References such as "left," right," "upward," "downward," and other directional references are for ease of reference to the figures.

Figure 1:
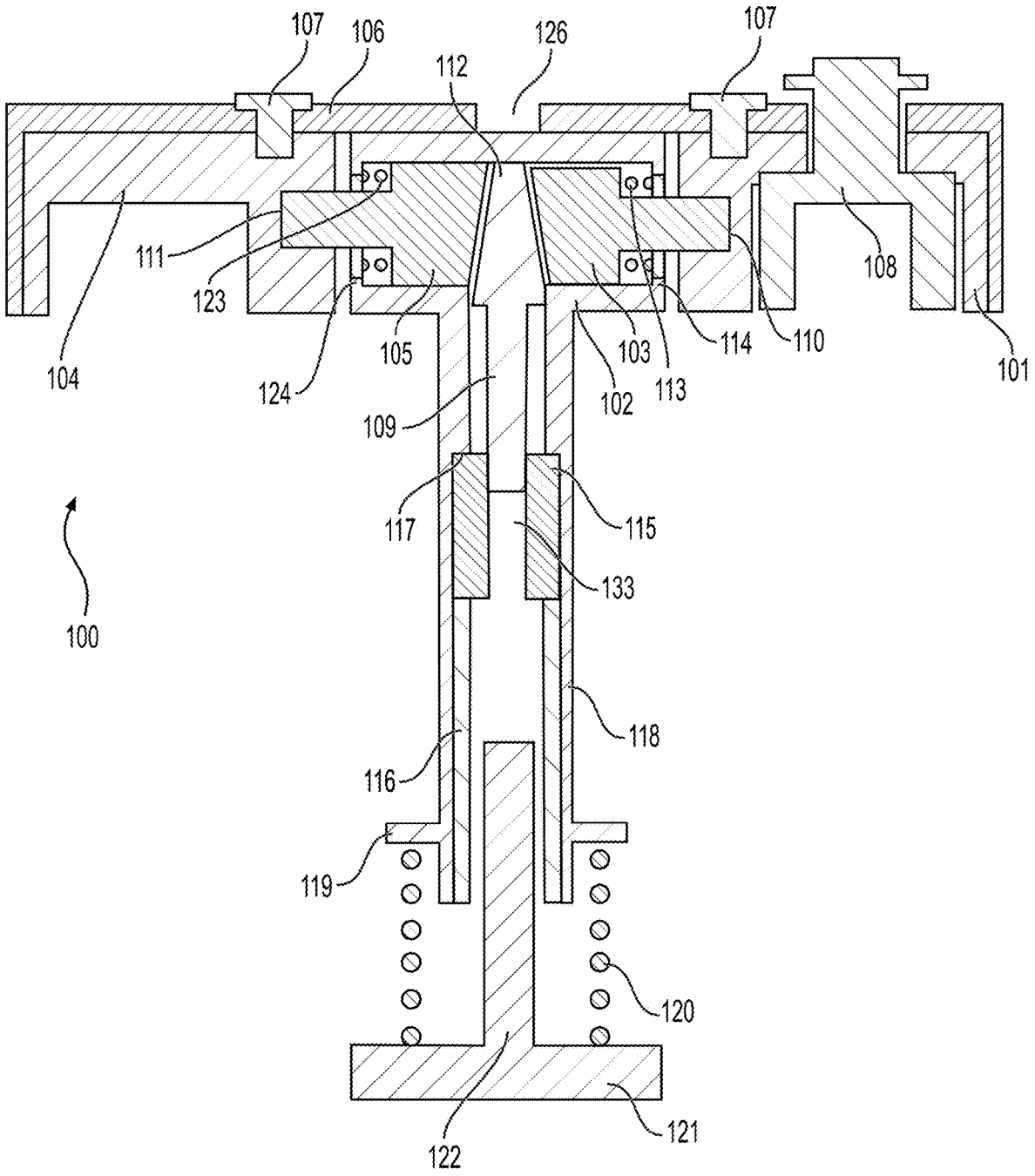
FIG. 1 is a cross-section view of a valvetrain assembly.

FIG. 1 shows a valvetrain assembly 100 comprising a first body 101 and a second body 102. The second body 102 comprises a first latch pin 103 that is configured to latch the second body 102 to the first body 101. In FIG. 1, the first body 101 is latched to the second body 102 in such a way that both the first body 101 and the second body 102 can move downward together, for example, when an e-foot ("elephant foot") or spigot or other rocker arm portion or rocker arm attachment presses downward against the second body 102. This is useful when the cylinder deactivation mode is off. In this mode, the second body 102 remains connected to the first body 101. Likewise, the second body 102 can remain latched to the third body 104 in a way that allows the third body 104 to move downward as the second body 102 moves downward. This can be achieved using the second latch pin 105 to connect the third body 104 to the second body 102. In this arrangement all three bodies—the first body 101, the second body 102, and the third body 104—can move both downward and upward in unison to apply a valve lift profile to affiliated first valve 129 and second valve 130.

Figure 2:
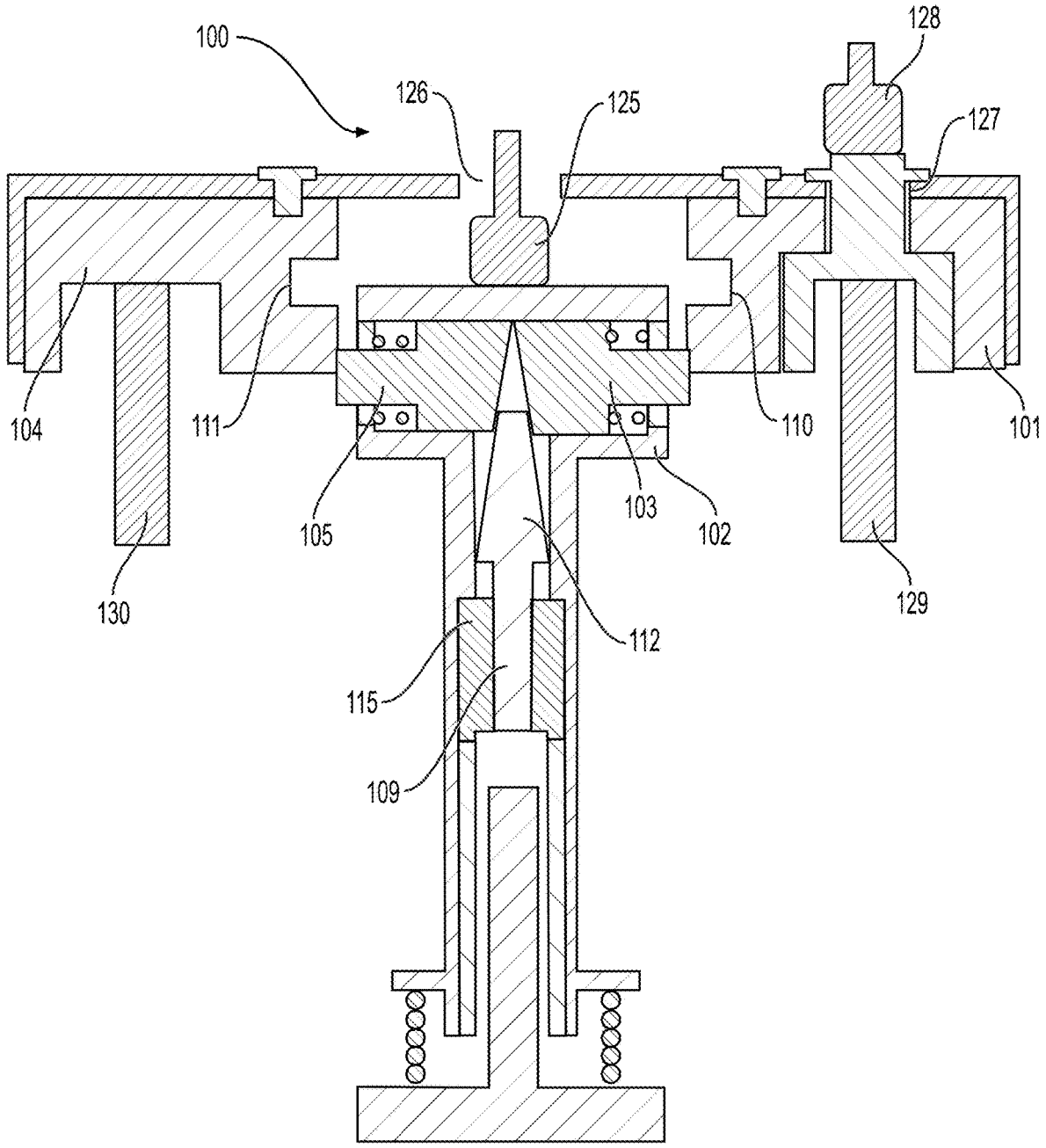
FIG. 2 is a cross-section view of a valvetrain assembly with a portion of the valvetrain assembly depressed.

As shown, for example, in FIG. 2, force delivered by a first e-foot 125 can cause this downward and upward motion. The e-foot 125 can be connected to a rocker arm, to a plunger, or to other mechanisms apparent to those skilled in the art. Any device that applies force to the second body 102 could suffice. For example, a rocker arm can directly or indirectly apply force to second body 102.

A cap 106 can connect the third body 104 to the first body 101, as shown in FIG. 1. One could fix the cap 106 to first body 101 or third body 104 using screws 107, bolts, pins, or any other fasteners apparent to those skilled in the art. The cap 106 can contain a first opening 126 and a second opening 127 to allow an e-foot to press against an object above or below the cap 106, including moving a portion of piston 108 through second opening 127, as shown, for example, in FIG. 2. A first e-foot 125 could engage the second body 102 and a second e-foot 128 could engage the piston 108 shown in FIG. 2. The cap 106 can be configured to restrict the upward movement of the second body 102. The second body 102 can be configured to selectively move towards and away from the cap 106.

The piston 108 could be part of an engine-brake system. The e-foot or other device that applies force to the piston 108 can move independently from the e-foot or other device that applies force to the second body 102.

FIG. 1 shows an arrangement useful in a valvetrain assembly 100 designed to move valves in an engine cylinder. For example, the valves might be exhaust valves. One could modify the arrangement in FIG. 1 to operate in a valvetrain assembly designed to move only one valve. This could be achieved by removing the third body 104 and its associated parts from the valvetrain assembly 100. One could also modify the valvetrain assembly 100 to link more than two bodies to move more than two valves. These valves need not be exhaust valves, and these valves could be intake valves or "5th valves" for example, and those skilled in the art could modify this valvetrain assembly to fit the needs and objectives of their device.

A movable shaft 109 can engage the first latch pin 103 to press the first latch pin 103 toward a first recess 110 in the first body 101. The movable shaft 109 can also engage a second latch pin 105 to press the second latch pin 105 toward a second recess 111 in the third body 104. The movable shaft head 112 of the movable shaft 109 can have a wedge-shaped portion that is an angular or conical shape configured to move the first latch pin 103 and the second latch pin 105 toward or away from the first recess 110 and the second recess 111. The movable shaft head 112 can be configured in any way or in a complimentary shape to move first latch pin 103 and second latch pin 105. When the movable shaft 109 moves downward, the first latch pin 103 can move away from the first recess 110. Likewise, the second latch pin 105 can move away from the second recess 111. When the movable shaft 109 moves upward, the wedge-shaped portion can move between the first latch pin 103 and the second latch pin 105 to drive the first latch pin 103 towards the first recess 110 and to drive the second latch pin 105 towards the second recess 111. To further facilitate the motion of the first and second latch pins 103, 105, the first latch pin 103 can comprise a wedge shape adjoining the wedge-shaped portion of the movable shaft 109, and the second latch pin 105 can comprise a wedge shape adjoining the wedge-shaped portion of the movable shaft 109.

FIG. 1 shows a first biasing mechanism 113 pressing against the first latch pin 103 and a first wall 114. The first biasing mechanism 113 can be a spring or any other biasing mechanism known to those skilled in the art. The valvetrain assembly 100 can include a second biasing mechanism 123 pressing against the second latch pin 105 and a second wall 124. A portion of the first latch pin 103 is located between the first wall 114 and the second wall 124. A portion of the second latch pin 105 is located between the first wall 114 and the second wall 124. The valvetrain assembly 100 can operate without a biasing mechanism when the first latch pin 103 and the second latch pin 105 are drawn or pushed toward one another by other means known to those skilled in the art, for example, using magnetic forces or hydraulic pressure. First wall 114 and second wall 124 can comprise, for example, a stepped bore portion and a plug or two inserts pressed in a through-bore, among other options for capping or enclosing the first and second latch pins 103, 105 in a latch bore.

An electromagnet 115 can be positioned in such a way that it can pull the movable shaft 109 away from the first latch pin 103 and the second latch pin 105. The electromagnet 115 can create a magnetic field when an electrical current runs through the electromagnet 115. The magnetic field can be turned off when the electromagnet 115 no longer receives an electrical current. In this way, one could configure the electromagnet 115 to turn on and off as the conditions demand. For example, a computer could send a signal to turn the current on when it is beneficial to keep an exhaust valve closed. Keeping an exhaust valve closed can improve fuel efficiency. Keeping a valve closed, including an exhaust valve or other valve, can reduce the energy needed to operate the valvetrain assembly because, for example, the closed valve no longer needs energy to move it.

The electromagnet 115 can be connected to a circuit using wires, springs, or other connections apparent to one skilled in the art. In an arrangement like the one shown in FIG. 1, springs could serve as a useful connection because they would allow the electromagnet 115 to move upward and downward as the second body 102 moves while also remaining in electrical connection with an electrical circuit.

FIG. 2 shows the valvetrain assembly 100 in an unlatched condition. In this arrangement, the e-foot 125 is pressing down against the second body 102 while the first latch pin 103 and the second latch pin 105 are positioned outside the first recess 110 and the second recess 111. This allows the second body 102 to move downward and upward while the first body 101 and third body 104 remain stationary. This can occur when the cylinder deactivation mode is turned on.

One benefit of this arrangement includes keeping a first valve 129 and a second valve 130 (shown schematically) closed while e-foot or rocker arm continues to move. The cylinder deactivation mode can be turned on by delivering a current to the electromagnet 115, thereby producing a magnetic field that draws the movable shaft 109 away from the first latch pin 103 and the second latch pin 105. The conical shape of the movable shaft head 112 allows the latch pins to move in a smooth, linear way. The conical shape also allows the movable shaft head 112 to remain engaged with both latch pins. The movable shaft head 112 is not limited to a conical shape. It can take any shape configured to move the latch pins to a desired position.

Because the latch pins are no longer positioned inside the first recess 110 and the second recess 111, for example, as shown in FIG. 2, they no longer engage the first body 101 and the third body 104. One can configure the electromagnet 115 to reverse its polarity, thereby pushing the movable shaft 109 toward the latch pins. In this arrangement, the electromagnet 115 could produce a magnetic field when the cylinder deactivation mode is turned on and also produce a magnetic field with reversed polarity when the cylinder deactivation mode is turned off. As the movable shaft head 112 moves toward the latch pins, it can press against the latch pins such that the latch pins move back into the first recess 110 and the second recess 111 when aligned with those recesses. In this way, the second body 102 reconnects with the first body 101 and the third body 104.

The valvetrain assembly 100 can be configured to move the movable shaft 109 toward the latch pins using any method or device apparent to those skilled in the art. For example, oil pressure, springs, and other biasing mechanisms can be used to push or pull the movable shaft 109 toward the latch pins. The electromagnet 115 can be configured in a way that allows it to receive an electrical signal, thereby maintaining a magnetic field. When the electromagnet 115 is turned off and the magnetic field disappears, then the movable shaft 109 can move toward the latch pins.

As shown in FIG. 1, the electromagnet 115 can sit in between a sleeve 116 and an edge 117 inside a cylinder wall 118 of the second body 102. The electromagnet 115 can comprise a magnet opening 133 in its center allowing the movable shaft 109 to move in and out of the magnet opening 133. The sleeve 116 can be threaded to allow one to secure it to the cylinder wall 118. The sleeve 116 could be fixed to the cylinder wall 118 by press-fitting it into the cylinder wall 118 or by using any other ways apparent to those skilled in the art. The movable shaft 109 can be arranged with the electromagnet 115 to move parallel to and within the cylinder wall 118 (FIG. 1-3), or the movable shaft 109 can be arranged with the electromagnet 201 to move perpendicular to and outside the cylinder wall 202 (FIGS. 4 & 5).

The valvetrain assembly 100 can include a spring support 119, a spring 120, and a flange 121 configured to bias the second body 102 upward toward the cap 106. The flange 121 can also include a first extension 122 that fits inside of the sleeve 116 to allow the second body 102 to move upward and downward along an axis. First extension 122, sleeve 116, and cylinder wall 118 can be configured to guide the movement of second body 102. Flange 121 and first extension 122 can be two different parts, for example, connected together using threads or press fitting. Also, flange 121 can be part of a cylinder head.

Figure 3:
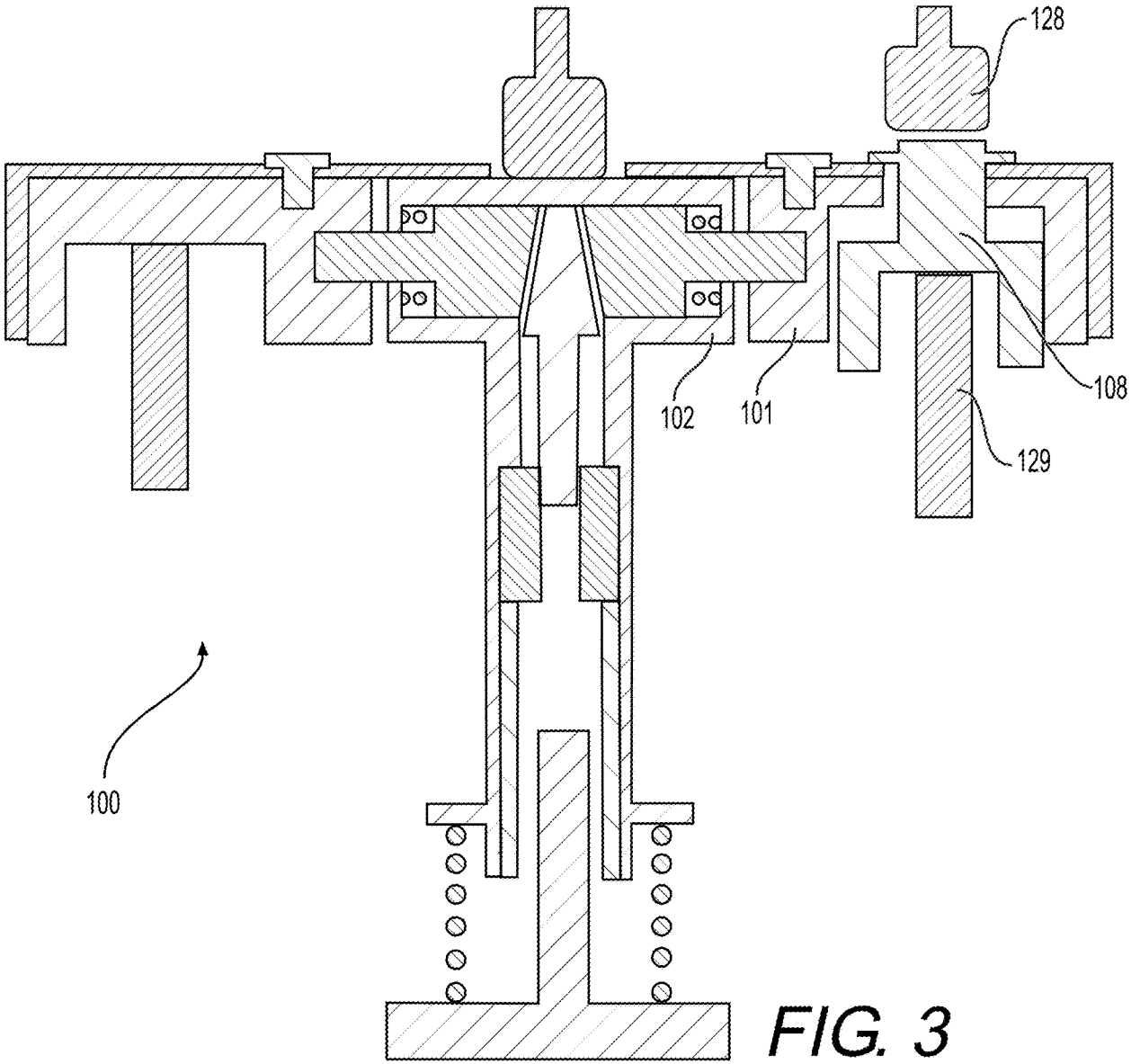
FIG. 3 is a cross-section view of a valvetrain assembly with a piston depressed.

FIG. 3 shows the valvetrain assembly 100 with a piston 108 depressed relative to the first body 101. The piston 108 can be depressed by e-foot, a rocker arm, or any other device apparent to one skilled in the art. For example, the piston 108 can be depressed by second e-foot 128. This arrangement allows one to activate an engine brake by opening first valve 129 connected to the piston 108. The engine brake can be activated by a computer or triggered by a switch operated by an operator of a vehicle that includes an engine brake. In this arrangement, the engine brake can be activated when the first body 101 is latched to the second body 102. The first body 101 can be configured to include other modifications apparent to those skilled in the art. Alternatives to engine braking can also be implemented, such as early or late valve opening or closing techniques.

Figure 4:
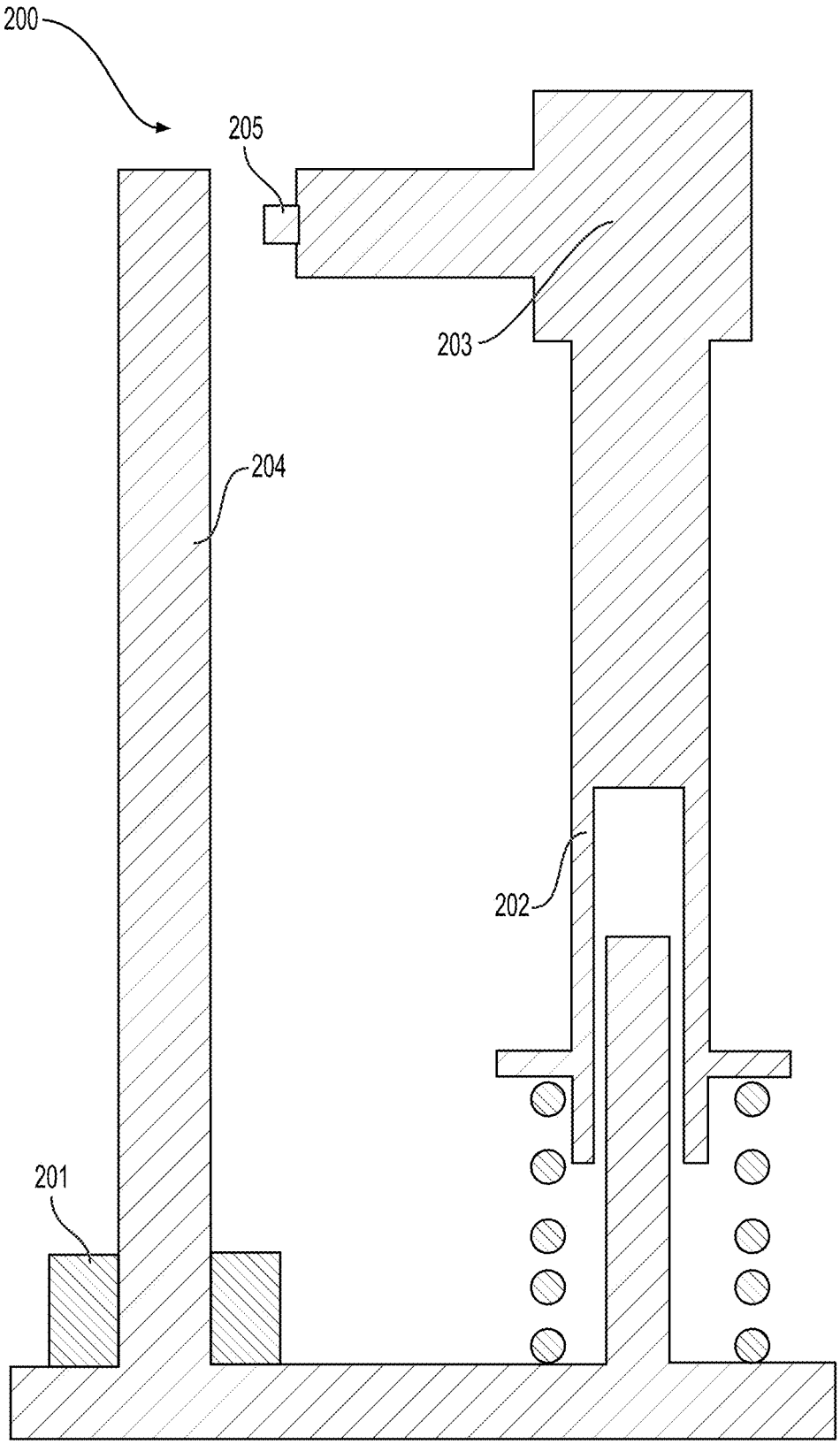
FIG. 4 is a cross-section view of a valvetrain assembly with an electromagnet located outside the cylinder wall of a portion of the valvetrain assembly.
Figure 5:
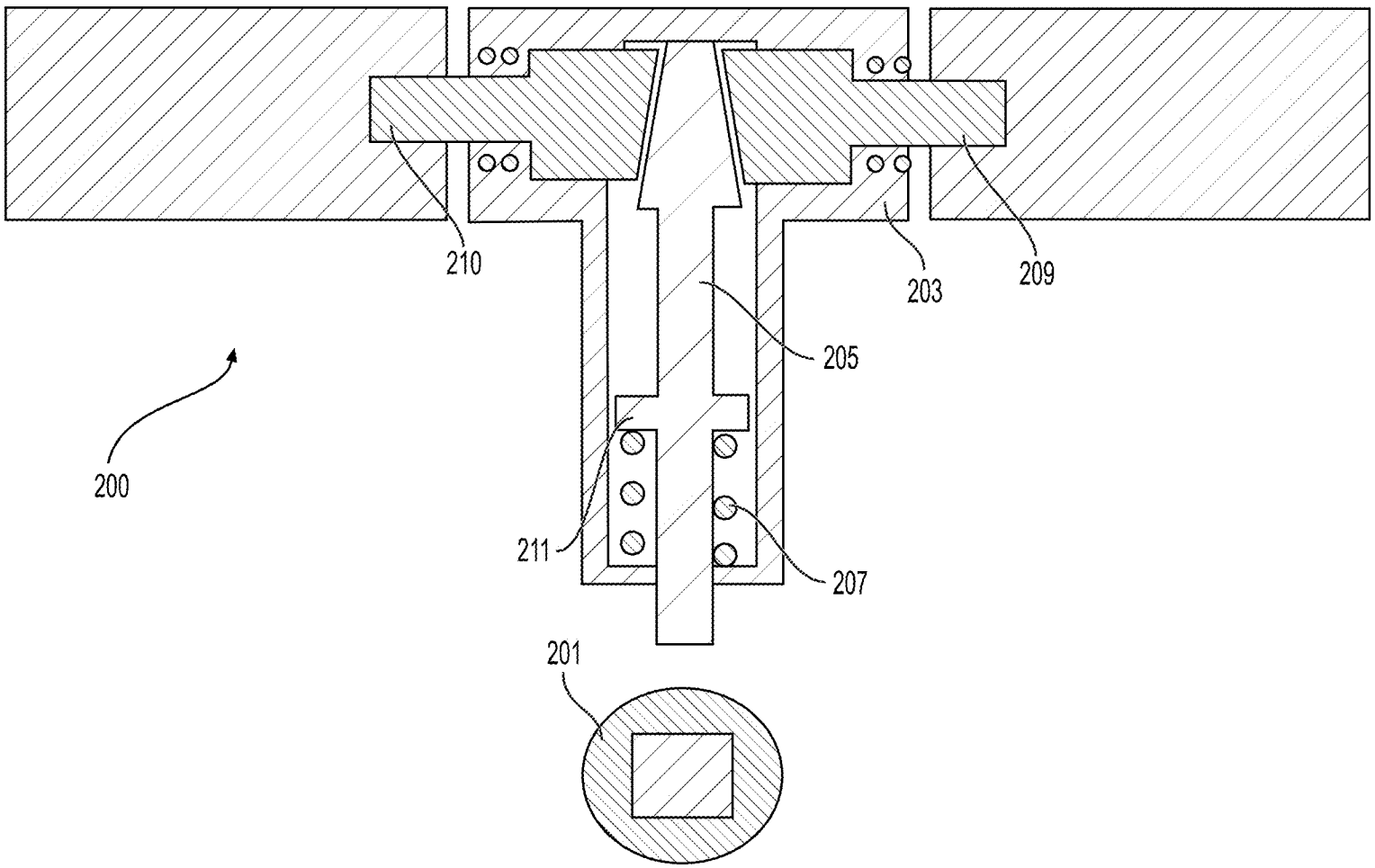
FIG. 5 is another cross-section view of a valvetrain assembly with an electromagnet located outside the cylinder wall of a portion of the valvetrain assembly.

FIG. 4 shows a side view of a valvetrain assembly 200 where an electromagnet 201 is located outside the cylinder wall 202 of the second body 203. The valvetrain assembly 200 can comprise a second extension 204 configured to draw a movable shaft 205 toward the second extension 204. The second extension 204 can be ferromagnetic. An electromagnet 201 can be configured to produce a magnetic field around the second extension 204. When the cylinder deactivation mode is turned on, the second extension 204 can draw the movable shaft 205 toward it. When the cylinder deactivation mode is turned off, the movable shaft 205 can move away from second extension 204 and toward a first latch pin and a second latch pin.

FIG. 5 shows a top view of a valvetrain assembly 200 with the electromagnet 201 located outside the cylinder wall 202 of the second body 203. As shown, the second body 203 can include a biasing mechanism 207 configured to bias the movable shaft 205 toward the latch pins 209, 210. The movable shaft 205 can include a spring support 211 engaged with a biasing mechanism 207. The biasing mechanism 207 can be a spring or any other biasing mechanism apparent to those skilled in the art. With a biasing mechanism 207 pressing against spring support 211 of the movable shaft 205, valvetrain assembly 200 can be configured in a way allowing the electromagnet 201 to use one direction of polarity during operation. Valvetrain assembly 200 can also be configured to operate effectively when electromagnet 201 has more than one direction of polarity in ways apparent to those skilled in the art.

Figure 6:
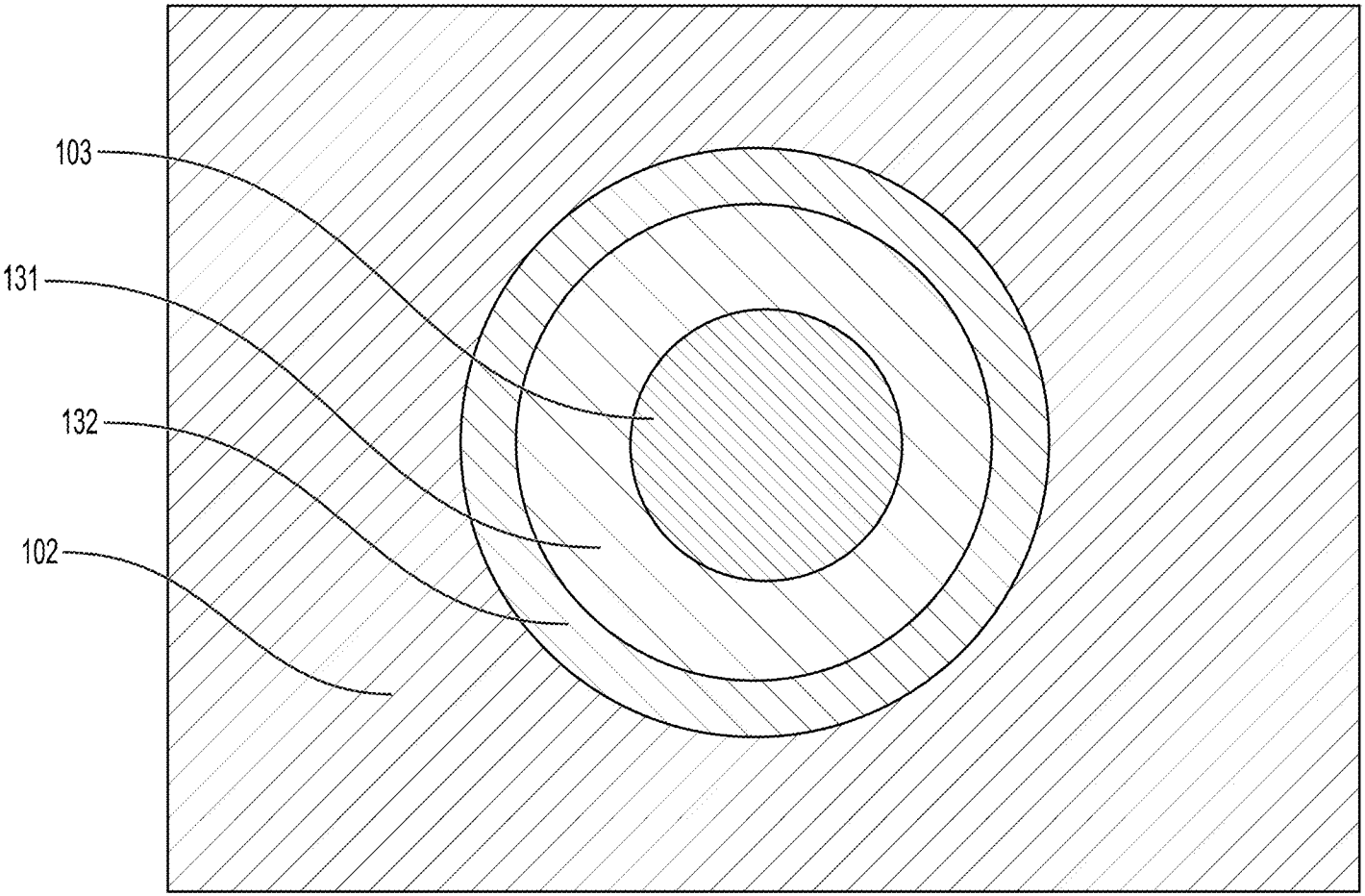
FIG. 6 is a side view of a portion of the valvetrain assembly where a latch pin is aligned with and fixed to a portion of the valvetrain assembly.

FIG. 6 shows a side view of a section of the second body 102 where the first latch pin 103 is located. The first latch pin 103 can be aligned with and attached to second body 102 using a washer 131, a circlip 132, or other devices and ways apparent to those skilled in the art. The first latch pin 103 can comprise a circular cross section or other shaped cross section.

Other implementations will be apparent to those skilled in the art from consideration of the specification and practice of the examples disclosed herein.

What is claimed is:

1. A valvetrain assembly, comprising:

a first body;

a second body, the second body comprising a first wall and a second wall;

a first latch pin, wherein the first latch pin is configured to latch the second body to the first body and unlatch the second body from the first body, and wherein a portion of the first latch pin is located between the first wall and the second wall;

a third body;

a second latch pin, wherein the second latch pin is configured to latch the second body to the third body and unlatch the second body from the third body, and wherein a portion of the second latch pin is located between the first wall and the second wall;

a movable shaft, the movable shaft configured to move the first latch pin; and an electromagnet, the electromagnet configured to move the movable shaft.

2. The valvetrain assembly of claim 1, wherein the second body comprises a cylinder wall, and wherein the electromagnet is located inside the cylinder wall.

3. The valvetrain assembly of claim 2, wherein the movable shaft is configured to move parallel to the cylinder wall.

4. The valvetrain assembly of claim 1, wherein the second body comprises a cylinder wall, and wherein the electromagnet is located outside the cylinder wall.

5. The valvetrain assembly of claim 4, wherein the movable shaft is configured to move perpendicular to the cylinder wall.

6. The valvetrain assembly of claim 1, comprising a ferromagnetic extension, the ferromagnetic extension configured to move the movable shaft.

7. The valvetrain assembly of claim 1, wherein the first body comprises a piston, the piston configured to move relative to the first body.

8. The valvetrain assembly of claim 1, wherein the movable shaft comprises a shaft head configured to move an adjoining first latch pin.

9. The valvetrain assembly of claim 8, wherein the first latch pin comprises a shape configured to be moved by the adjoining shaft head.

10. The valvetrain assembly of claim 1, wherein the movable shaft is configured to move a shaft head between the first latch pin and the second latch pin.

11. The valvetrain assembly of claim 10, wherein the first latch pin comprises a wedge shape adjoining the shaft head of the movable shaft, and wherein the second latch pin comprises a wedge shape adjoining the shaft head of the movable shaft.

12. The valvetrain assembly of claim 1, further comprising a cap configured to join the first body with the third body.

13. The valvetrain assembly of claim 12, wherein the cap is configured to restrict a movement of the second body, and wherein the second body is configured to selectively move towards and away from the cap.

14. The valvetrain assembly of claim 12, further comprising a spring configured to bias the second body toward the cap.

15. The valvetrain assembly of claim 12, comprising:

a piston;

an e-foot;

a first opening in the cap; and a second opening in the cap, wherein the second opening is configured to allow an e-foot to move a portion of the piston through the second opening.

* * * * *